United States Patent [19]

Hageman

[11] Patent Number: 4,837,095

[45] Date of Patent: Jun. 6, 1989

[54] IN SITU ROOFING COMPOSITE AND METHOD UTILIZING WIDER POLYESTER

[76] Inventor: John P. Hageman, 42 Susan Dr., Closter, N.J. 07624

[21] Appl. No.: 836,756

[22] Filed: Apr. 21, 1986

Related U.S. Application Data

[63] Continuation of Ser. No. 715,285, Mar. 25, 1985, abandoned, Continuation-in-part of Ser. No. 704,143, Feb. 21, 1985, abandoned, Continuation of Ser. No. 642,576, Aug. 20, 1984, Pat. No. 4,521,478.

[51] Int. Cl.[4] ..... B32B 3/10

[52] U.S. Cl. ..... 428/287; 156/71; 428/150; 428/283; 428/291; 428/316.6; 428/318.4; 428/480; 428/489

[58] Field of Search ..... 428/141, 143, 150, 139, 428/140, 281, 282, 283, 291, 489, 480, 491, 316.6, 318.4; 156/7 L

[56] References Cited

U.S. PATENT DOCUMENTS

| | | | |
|---|---|---|---|
| 3,094,447 | 6/1963 | Chamberlain | 428/489 |
| 3,135,069 | 6/1964 | Schuller et al. | 428/139 |
| 3,369,956 | 2/1968 | Schuetz et al. | 428/281 |
| 3,369,958 | 2/1968 | Fleeman | 428/282 |
| 3,672,951 | 6/1972 | Moore et al. | 428/489 |
| 3,967,032 | 6/1976 | Plotz et al. | 428/489 |
| 4,136,223 | 1/1979 | Harder | 428/139 |
| 4,230,762 | 10/1980 | Iwasaki et al. | 428/287 |
| 4,233,353 | 11/1980 | Bondoc et al. | 428/141 |
| 4,521,478 | 6/1985 | Hageman | 428/287 |

*Primary Examiner*—Paul J. Thibodeau
*Attorney, Agent, or Firm*—Robert S. Salzman

[57] ABSTRACT

The invention comprises a built-up roof material that has a composite membrane that is formed and affixed to the roof substrate in a single step. The membrane comprises a sheet of heat-resistant, non-woven polyester sandwiched between layers of asphalt. The upper asphalt layer is caused to flow through the polyester and meld with the lower layer of asphalt to form a homogeneous membrane. The polyester sheet is layed in strips side-by-side across the asphalt in widths greater than forty inches across, in order to reduce the number of seams and to conform more closely to the contours of the roof substrate.

11 Claims, 1 Drawing Sheet

IN SITU ROOFING COMPOSITE AND METHOD UTILIZING WIDER POLYESTER

RELATED APPLICATION

This application is a continuation of the parent application, Ser. No. 715,285, now abandoned which in turn is a continuation of Ser. No. 704,143, filed 2/21/85, now abandoned which is a continuation-in-part of Ser. No. 642,576, now U.S. Pat. No. 4,521,478.

FIELD OF THE INVENTION

This invention relates to roofing construction materials and methods, and more particularly to an in situ roofing composite and method of fabricating same utilizing wider polyester.

BACKGROUND OF THE INVENTION

In recent times, the use of asphalt-impregnated polyester sheet for roofing construction has been found to provide excellent results. The polyester sheeting is generally treated with asphalt and other water-resistant materials in the factory, because of the difficulties experienced with applying water-proofing materials to the polyester at the roof site. Untreated, non-woven polyester sheet does not generally withstand heat, and does not easily absorb hot asphalt.

Untreated, polyester sheet has been used with asphalt in cold-process roofing systems, wherein the asphalt is modified with latex or polypropylene and sprayed in a cold liquid state upon the polyester sheet. The cold process roofing systems have not been entirely satisfactory, because they tend to remain tacky for many months. This tackiness hinders the completion, repair and/or inspection of the roof, since the roof cannot be walked upon while tacky.

Even where hot asphalt systems have been contemplated with the use of polyester sheet, the asphalt generally requires torching on the roof, which is an unsafe, fire-hazardous procedure.

Therefore, most roofing applications using polyester materials have been with a polyestermat, i.e., a factory asphalt-impregnated polyester sheet.

The drawback of using factory impregnated polyester sheeting, however, is the high cost and inconvenience of shipping and handling these heavy rolls of material.

The present invention contemplates the construction of a roof using a polyester-hot asphalt or coal tar process at the roofing site, without the aforementioned disadvantages.

Hot, built-up roofing can now use plain, non-woven polyester sheet for the reasons that the polyester is now being manufactured with a resin treatment that assists the polyester to withstand the temperature (450 degrees F.) of hot asphalt and other hot-applied water-proofing ingredients.

In addition, torching the asphalt on the roof is no longer necessary with the advent of a new hot pumping system, wherein the asphalt is pumped in a hot fluid state to the roof.

The advantages of building-up a roof with hot water-proofing ingredients and polyester sheeting are many.

The rolls of plain, non-woven polyester sheet are light in weight and inexpensive to purchase and ship.

Plain polyester rolls are easier to work with, and a single, light-weight ply is often all that is required to produce an efficacious roof construction.

According to this invention, the polyester and asphalt layers can be melded together and simultaneously directly attached to the roof substrate as a composite membrane. This inventive method of forming and affixing a composite membrane simultaneously, in situ, not only reduces the costs of fabrications, but also provides a roof of better quality and adhesion.

The inventive method and construction will be explained in more detail, hereinafter.

The composite membrane technique of this invention can be used with different roof base sheets or substrates and overlays of foam, such as polyurethane and isocyanurate, to provide a roof composite construction of exceptional durability.

The polyester sheet is manufactured in a wide strip of approximately 162 inches in width. This strip is trimmed at each edge to provide a finished large strip of approximately 160 inches across. The large 160 inch strip is then cut into quarters to provide the standard forty inch strips common to the industry.

The forty inch roofing strip is a standard strip size used for the past 40 years. The reason the roofing strips were never cut larger, was probably the result that most strips of fiberglass, felt and pre-impregnated asphalt materials were too heavy to conveniently handle and ship in larger width sizes.

However, with the advent of the light-weight polyester sheet of this invention, came the idea that larger width sizes could be utilized in order to reduce the amount of loading and handling of the polyester rolls.

Also, the use of wider sheet reduces the amount of seams on the roof by one-third. The reduction of the number of seams is beneficial in two ways: (a) it reduces the amount of labor in applying the sheets in side-by-side fashion; and (b) it reduces the probability of leaks, because the seams are the weakest part of the roof construction.

In a recent experimental construction of a roof, it has been unexpectedly found, that another advantage is to be gained from the use of wider polyester stripping.

Polyester strips of approximately fifty-four (54) inches in width were used and found to drape more easily over the uneven surfaces of the roof substrate and/or base sheets, i.e. the wider polyester strips more closely conformed to the existing roof surface. This conformity has the advantage of providing a roof with a more level and even surface. Water run-off can be more carefully controlled, and puddling can be eliminated or reduced.

The reason that wider strips conform more closely is not known, but it is probably a result of the increase in flexure that the wider strip provides.

Another advantage of the wider width size, provides that only two cuts (3 strips) rather than three cuts (four strips) need be made in the 160 inch master sheet. This naturally will reduce manufacturing equipment and blade wear.

It is also contemplated that widths of weight (80) inches may be used, to further reduce labor and manufacturing costs.

DISCUSSION OF RELATED ART

The use of a woven polyester sheet for cold process roof systems using an emulsion of latex and asphalt is shown in German Pat. No. 2200881. This technique is not similar to this invention in that a cold process is used rather than a hot process, and a woven rather than a non-woven sheet of polyester is utilized. Such a system using an asphalt emulsion will remain tacky, and as such, is not practical.

In the U.S. Pat. No. 4,230,762, issued to Iwasaki et al; on Aug. 15, 1978, a non-woven fabric which is impregnated at the factory with asphalt, is described. This patent does not suggest using a plain, unpregnated polyester sheet in situ. As previously described, factory impregnated material is expensive to ship due to the added weight, and is further difficult to handle.

In U.S. Pat. No. 3,369,958, issued to H. Fleeman on Feb. 20, 1968, an embossed sheet of polythene or polyvinyl chloride is suggested as a material which can withstand the heat generated by hot asphalt roofing techniques. This patent does not suggest the specific use of polyester sheeting. Also, this patent does not suggest the flow of asphalt through the sheet to form a composite membrane, and one which can be directly applied in one step.

BRIEF SUMMARY OF THE INVENTION

This invention features a built-up, in situ roofing composite having a membrane that is both formed and affixed to a roof substrate in a single, simultaneous step. The roofing composite comprises a first layer of water-proofing ingredients applied to a roof base sheet or substrate. The ingredients can be selected from a group consisting of asphalt, modified asphalt and coal tar.

Over this first layer, at least a single ply of non-woven polyester sheeting is laid. The polyester sheeting comprises polyester strips layed side-by-side upon the first layer of asphalt or coal tar in widths greater than forty (40) inches across. The polyester sheet has an approximate weight in the rage of 4 to 14 ounces per square yard. Preferably, the polyester has a weight of approximately 5.5 to 7.5 ounces per square yard.

A second layer of water-proofing ingredients is applied over the polyester. The second layer of ingredients is allowed to flow through the polyester and meld with the first layer, thus forming a build-up composite membrane that is affixed to the roof substrate.

Over the membrane composite is applied a heat resistant layer of material, such as gravel, foam or a layer of mastic followed by granules. The foam may be a polyurethane or an isocyanurate. Similarly, the roof substrate may comprise a foam.

The polyester sheet may be embossed prior to its installation to give the sheeting improved suppleness and adhesion.

The composite roofing made in the above manner exhibits a durability uncommon with present day techniques and is substantially split-resistant.

It is an object of the invention to provide an improved roof composite and method of fabricating same.

It is another object of this invention to provide a roof composite that includes a membrane that is formed and affixed to the roof substrate in a single, simultaneous step.

These and other objects of the invention will be better understood and will become more apparent with reference to the subsequent detailed description considered in conjunction with the accompanying drawings.

DETAILED DESCRIPTION OF THE INVENTION

Generally speaking, the invention features a built-up, in situ roofing composite, wherein a water-proof membrane is formed and affixed to a roof substrate in a single fabricating step. The composite and method of its fabrication will be described with reference to FIGS. 1 through 3, wherein like elements have been assigned the same designation for the sake of brevity.

Figure 1:
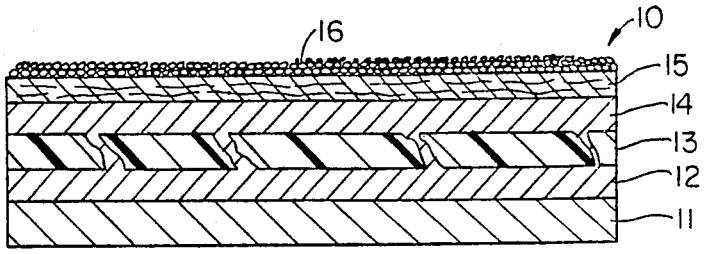
FIG. 1 is a sectional exaggerated view of the roof composite of this invention.

Now referring to FIG. 1, a roof composite 10 attached to a roof base sheet or substrate 11 is illustrated in a sectional view. The composite 10 is made up of several layers of materials, the first of which is a layer of asphalt 12. The asphalt can be applied in a temperature range of between 350 degrees F. to 480 degrees F. depending on the type of asphalt used, i.e., dead level, flat or steep. Modified asphalt (treated with latex) as well as coal tar may be used for layer 12.

Preferably a steep asphalt is applied. The asphalt is heated to 450 degrees F. in a temperature-controlled bulk tanker. The tanker keeps the asphalt at a constant temperature, critical for successfully apply polyesters.

Using a bulk tanker also enables the crew to start the job as soon as they get to the site, rather than having to wait for the asphalt to heat up. It provides a steady supply of hot asphalt, keeping production rates high. Plus, the tanker eliminates smoke and fumes, is safer than kettles, and uses less propane.

The asphalt is pumped up to an asphalt spreader or a small hot lugger. One mechanic spreads about 50 pounds per square feet of the hot asphalt with a mop.

Over the asphalt layer 12 is disposed a layer 13 of resintreated, non-woven polyester. The resin treatment allows the polyester to withstand the heat of the asphalt.

As the asphalt is mopped onto the roof base sheet or substrate 11, another worker unrolls a 50 lb. roll of the polyester sheeting into the asphalt layer 12. The roll is approximately fifty-four (54) inches in width. Each roll is laid-out side-by-side with an adjacent roll, until the entire roof is constructed.

Another worker then covers the polyester sheet layer 13 with another 50 pounds per square feet of asphalt, thus forming layer 14. The asphalt 14 is allowed to penetrate the polyester layer 13.

The polyester sheet is 68 mils thick, so it requires a lot of asphalt to fill the polyester layer 13.

The asphalt layer 14 is broomed into the polyester layer 13 to ensure good penetration. The asphalt is broomed sideways across the polyester, so that the polyester is not stepped on by the worker, and the underlayer of asphalt 12 is not displaced.

The penetrating asphalt layer 14 melds with the underlayer 12 and then rises back up through the polyester layer 13.

When the asphalt layer 14 is "broomed-in," a polyester and asphalt composite membrane is formed and securely attached to the roof substrate 11 all in one step.

Figure 2:
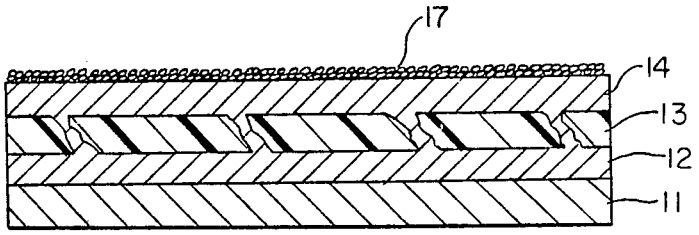
FIG. 2 is a sectional exaggerated view of an alternate embodiment of the roof composite shown in FIG. 1.
Figure 3:
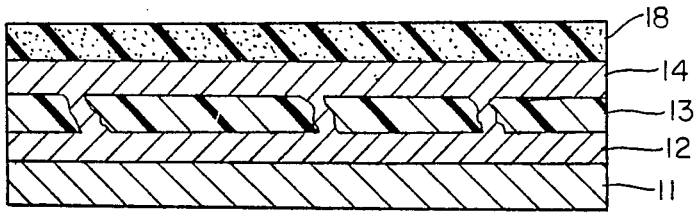
FIG. 3 is a sectional exaggerated view of another alternate embodiment of the roof composite illustrated in FIG. 1.

The asphalt layer 14 must be shielded from the harmful ultraviolet rays of the sun. Also, the polyester layer 13 must be kept cool. Therefore, a heat-resistant insulating layer is required over the asphalt layer 14. FIGS. 1 through 3 show three different ways of covering the membrane composite.

FIG. 1 illustrates a first method wherein a mastic layer 15 is coated over asphalt layer 14, and then a layer of ceramic granules 16 is embedded in the mastic layer 15.

The mastic layer 15 comprises asphalt in a solvent, such as mineral spirits. Asbestos or fiberglass may be added to the mastic composition.

The granules 16 are poured into a ground-level machine manufactured by Kold-King of Denver, Colo. that pumps them to the roof and sprays them over the mastic layer 15.

In FIG. 2, a layer 17 of gravel is directly applied on top of the asphalt layer 14.

In FIG. 3, a layer 18 of foam is applied over the asphalt layer 14. The foam can be a polyurethane or an isocyanurate made by the Upjohn Company.

The substrate 11 on the roof can be the roof top surface or it may comprise a foam applied over the top surface. The foam for the substrate 11 can also be a polyurethane or isocyanurate.

The foam in layers 11 and/or 18 can be sprayed or applied in blocks or sheets.

The polyester sheeting can be laid in single, double or triple ply. The polyester sheet can range in weight from 4 to 14 ounces per square yard.

The resin-treated non-woven polyester sheet is made by the Hoechst Company, New Jersey under the trade name of Trivera R.

Another polyester sheet that can be used in not-roofing systems is made by Du Pont Co. of Wilmington, Del., called Reemay Hot. This sheet is a polyester and fiberglass laminate.

The granules 16 are type 11 made by the 3M Company of Bellmede, N.J. Granules can also be purchased from GAF Corporation.

The mastic can be purchased from the Monsey Corporation of East Rutherford, N.J.

The asphalt can be purchased from the Exxon Corporation.

The roof composite of this invention is substantially split-resistant. This is very significant, since the major cause of failure in contemporary roofing is splitting.

Figure 4:
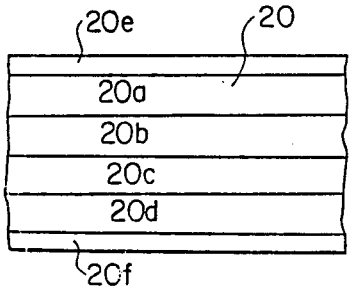
FIG. 4 is a plan view of a master sheet (160 inch) of polyester being cut into standard, prior art widths of approximately forty (40) inches across.

Referring now to FIG. 4, a master sheet 20 of polyester is shown being cut at the factory into standard, prior art quarter widths 20*a*, 20*b*, 20*c* and 20*d*, respectively. The master sheet of approximately 162 inches is trimmed by first cutting about one (1) inch from each side, as illustrated by trimmed sections 20*e* and 20*f*, respectively. The quartered strips 20*a*, 20b, 20c and 20*d* are each approximately forty (40) inches across. The strips 20*a*, 20*b*, 20*c* and 20*d* are then spun into rolls and shipped.

Figure 5:
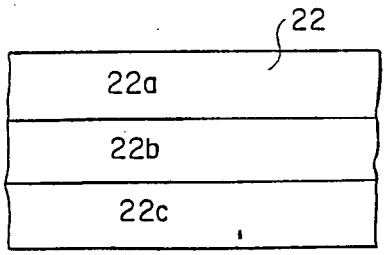
FIG. 5 is a plan view of the master sheet (160 inch) of polyester being cut into approximately fifty-four (54) inch widths according to this invention.

Referring now to FIG. 5, the manufacturing procedure of this invention is shown, wherein the master sheet 22 of approximately 162 inches is cut into thirds, yielding strips 22*a*, 22*b* and 22*c*, respectively.

The strips 22*a*, 22*b* and 22*c* are each approximately fifty-four inches in width, and the trimming shown in FIG. 4 is optional. In other words, the trimming step may not be necessary, since even one-third cuts of the master sheet 22 is possible without trimming.

The strips 22*a*, 22*b*, and 22*c*, are then spun into rolls and loaded for shipment.

These newly sized strips (22*a*, 22*b* and 22*c*) are laid side-by-side on the under layer of asphalt 12, when a roof is constructed. The number of rolls of polyester strips will be less, and the number of seams will be reduced by one-third in constructing the roof using the wider rolls.

In addition, a flatter and more even roof surface will result with the use of these wider rolls.

Having thus described the invention, what is desired to be protected by Letters Patent is presented by the subsequently appended claims.

What is claimed is:

1. A built-up, in situ roofing composite comprising:

a first layer of water-proofing ingredients applied to a roof base sheet or substrate, said ingredients selected from a group consisting of asphalt, modified asphalt and coal tar;

at least a single ply of non-woven polyester sheeting overlaying said first layer, said sheeting comprising polyester strips layed side-by-side upon the first layer in widths of approximately fifty-four inches across;

a second layer of water-proofing ingredients applied over said polyester, said second layer flowing through said polyester and melding with said first layer to form a built-up composite membrane which is affixed to said substrate; and an insulating, heat-resistant layer of material disposed over said built-up composite membrane forming a roofing composite that is substantially split-resistant.

2. The built-up roofing composite of claim 1 wherein said insulating layer comprises a material selected from a group consisting of gravel, granules and heat-resistant foam.

3. The built-up roofing composite of claim 2, wherein said foam comprises a polyurethane.

4. The built-up roofing composite of claim 2, wherein said foam comprises an isocyanurate.

5. The built-up roofing composite of claim 1, wherein said polyester has a weight in a range of approximately 4 to 14 ounces per square yard.

6. The built-up roofing composite of claim 5, wherein said polyester has a weight in an approximate range of 5.5 to 7.5 ounces per square yard.

7. The built-up roofing composite of claim 1, wherein said polyester is embossed.

8. The built-up roofing composite of claim 1, wherein said roof substrate comprises a foam material.

9. The built-up roofing composite of claim 1, wherein said insulating material comprises granules, and further comprising a layer of mastic disposed between said second layer and said granules.

10. A built-up, in situ roofing composite comprising:

a first layer of water-proofing ingredients applied to a roof base sheet or substrate, at least a single ply of non-woven polyester sheeting overlaying said first layer, said sheeting comprising polyester strips layed side-by-side upon the first layer in widths of approximately one-third the width of a master sheet, a second layer of water-proofing ingredients applied over said polyester strips, said second layer flowing through said polyester strips and melding with said first layer to form a built-up composite membrane which is affixed to the base sheet or substrate, and an insulating, heat-resistant layer of material disposed over said built-up composite membrane forming a roofing composite that is substantially split-resistant.

11. A built-up, in situ roofing composite comprising:

a first layer of water-proofing ingredients applied to a roof base sheet or substrate, at least a single ply of non-woven polyester sheeting overlaying said first layer, said sheeting comprising polyester strips layed side-by-side upon the first layer in widths of approximately one-half the width of a master sheet, a second layer of water-proofing ingredients applied over said polyester strips, said second layer flowing through said polyester strips and melding with said first layer to form a built-up composite membrane which is affixed to the base sheet or substrate, and an insulating, heat-resistant layer of material disposed over said built-up composite membrane forming a roofing composite that is substantially split-resistant.

* * * * *